US006816123B2

(12) United States Patent
Eom et al.

(10) Patent No.: US 6,816,123 B2
(45) Date of Patent: Nov. 9, 2004

(54) CONTACT TYPE ANTENNA APPARATUS

(75) Inventors: Sang-jin Eom, Incheon (KR); Sang-min Lee, Seoul (KR); Jeong-whan Lee, Suwon (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 10/283,335

(22) Filed: Oct. 30, 2002

(65) Prior Publication Data

US 2003/0080914 A1 May 1, 2003

(30) Foreign Application Priority Data

Nov. 1, 2001 (KR) ..... 10-2001-67828

(51) Int. Cl.[7] ..... H01Q 13/00
(52) U.S. Cl. ..... 343/786; 343/840
(58) Field of Search ..... 343/785, 786, 343/789, 840

(56) References Cited

U.S. PATENT DOCUMENTS 3,740,754 A * 6/1973 Epis ..... 343/797
4,164,718 A * 8/1979 Iwasaki ..... 333/81 R
4,504,836 A * 3/1985 Seavey ..... 343/761
4,668,956 A * 5/1987 Mahnad ..... 343/789
4,672,388 A * 6/1987 Grim ..... 343/786
RE32,835 E * 1/1989 Howard ..... 333/21 A
5,461,394 A * 10/1995 Weber ..... 343/786
5,874,924 A * 2/1999 Csongor et al. ..... 343/797
6,137,449 A * 10/2000 Kildal ..... 343/781 P

FOREIGN PATENT DOCUMENTS

JP 8-313576 11/1996

* cited by examiner

*Primary Examiner*—Tan Ho
(74) *Attorney, Agent, or Firm*—Lee & Sterba, P.C.

(57) ABSTRACT

Provided is an antenna apparatus including an antenna for receiving electromagnetic radiation from an object to be measured; and a condensing element, which is constructed to surround the antenna, which is located at a center of the condensing element, wherein the condensing element reflects and condenses the electromagnetic radiation toward the antenna. The antenna apparatus according to the present invention improves the gain and electromagnetic reception efficiency of the antenna and effectively reduces interference by external unwanted noise.

10 Claims, 5 Drawing Sheets

CONTACT TYPE ANTENNA APPARATUS

BACKGROUND OF THE INVENTION

1. Field of the Invention

The present invention relates to an antenna apparatus. More particularly, the present invention relates to an antenna apparatus capable of improving electromagnetic wave reception efficiency.

2. Description of the Related Art

In general, an antenna is an apparatus for converting an electric signal into electromagnetic wave energy to spatially radiate out or for receiving and converting electromagnetic wave energy into an electrical signal. Antennas may be classified into two types. A first type is a contact type antenna, which detects electromagnetic radiation in contact with a target object. A second type is a non-contact type antenna, which detects electromagnetic radiation separated from a target object.

Examples of use of a contact type antenna include a radiometer, a dielectric load detector for geological survey, a hyperthermia apparatus, a non-invasive detector, or a terminal probe for medical equipment.

A radiometer is a device for measuring the characteristics of an arbitrary electromagnetic medium and changes therein by receiving electromagnetic radiation from the electromagnetic medium at a frequency of about 1 GHz to 100 GHz. For example, a radiometer for a body is a device that passively receives and analyzes a radio frequency (RF) signal radiated from every electromagnetic medium having a temperature greater than absolute zero of the Kelvin scale by using a contact type antenna. A hyperthermia apparatus is a non-invasive treatment apparatus for radiating electromagnetic waves into the human body through a contact type antenna for therapeutic purposes. A geological survey apparatus or a non-invasive detection apparatus radiates signals into or receives signals from an object by contacting an antenna to the object to analyze the inside of the object.

Since the contact type antenna receives electromagnetic radiation while in contact with a target object to be measured, the initial position and angle of the antenna may be changed while it is in contact with the object. In a measuring apparatus using a conventional contact type antenna, a necessary signal (i.e., the signal intended to be received) is greatly affected by minor lobes due to unwanted noise in the boundary between free space and the object. In particular, in a radiometer for processing a weak RF signal, electromagnetic noise due to such minor lobes seriously affects the entire system, even if the noise level may be very low.

Many attempts have been made to improve the directional gain in a conventional contact type antenna. The type of antenna, however, limits gain improvement. Dynamics of a radiation pattern from an arbitrary medium in contact with the antenna is another consideration.

In the context of the present invention, the term "gain" indicates the extent to which radio waves radiate in a particular desired direction. A "main lobe" indicates most of the electromagnetic field transmitted or received via an antenna, which radiates in a particular direction. A "minor lobe" indicates a weak electromagnetic field pattern radiated or received via an antenna, which radiates in another direction.

Rapid advances in the electronics industry have seriously increased noise in almost all frequency bands. For this reason, some radiometer designers are searching for frequency bands that are less affected by noise for use in new systems. A particular frequency band, however, is required for a particular function of equipment using an antenna, such as a radiometer. Therefore, there is a need to develop a high-gain antenna apparatus that is less affected by external noise and has improved accuracy and reliability. To improve the gain and electromagnetic reception efficiency of the antenna, an antenna apparatus capable of suppressing signal loss via the antenna and capable of blocking noise is needed.

SUMMARY OF THE INVENTION

In an effort to solve the above problems, it is a feature of an embodiment of the present invention to provide an antenna apparatus with improved reception efficiency, capable of blocking noise from entering via an antenna thereof.

To provide this feature of an embodiment of the present invention, there is provided an antenna apparatus including: an antenna for receiving electromagnetic radiation from an object to be measured; and a condensing element, which is constructed to surround the antenna, which is located at a center of the condensing element, wherein the condensing element reflects and condenses the electromagnetic radiation toward the antenna.

Preferably, the antenna is a contact type antenna that directly contacts the object to be measured. The condensing element is preferably formed of a conductive metal.

Preferably, the condensing element includes: an interior wall including an electromagnetic reflecting material to reflect and converge the electromagnetic radiation toward the antenna; an exterior wall including an electromagnetic reflecting material to shield external electromagnetic radiation not originating from the object to be measured; and an intermediate wall between the interior wall and the exterior wall, which includes at least one groove formed to a predetermined depth in a direction of wave propagation. In the antenna apparatus, the interior wall may be semi-spherical, spherical, or cylindrical.

Preferably, the interior wall and the exterior wall have different heights. Alternatively, the interior wall and the exterior wall may have an equal height.

Also preferably, the at least one groove contains an electromagnetic reflecting material or an electromagnetic absorbing material on an inner surface thereof.

Preferably, a top surface of the intermediate wall is inclined toward the antenna.

BRIEF DESCRIPTION OF THE DRAWINGS

The above and other features and advantages of the present invention will become readily apparent to those of ordinary skill in the art by describing in detail preferred embodiments thereof with reference to the attached drawings in which.

DETAILED DESCRIPTION OF THE INVENTION

Figure 1:
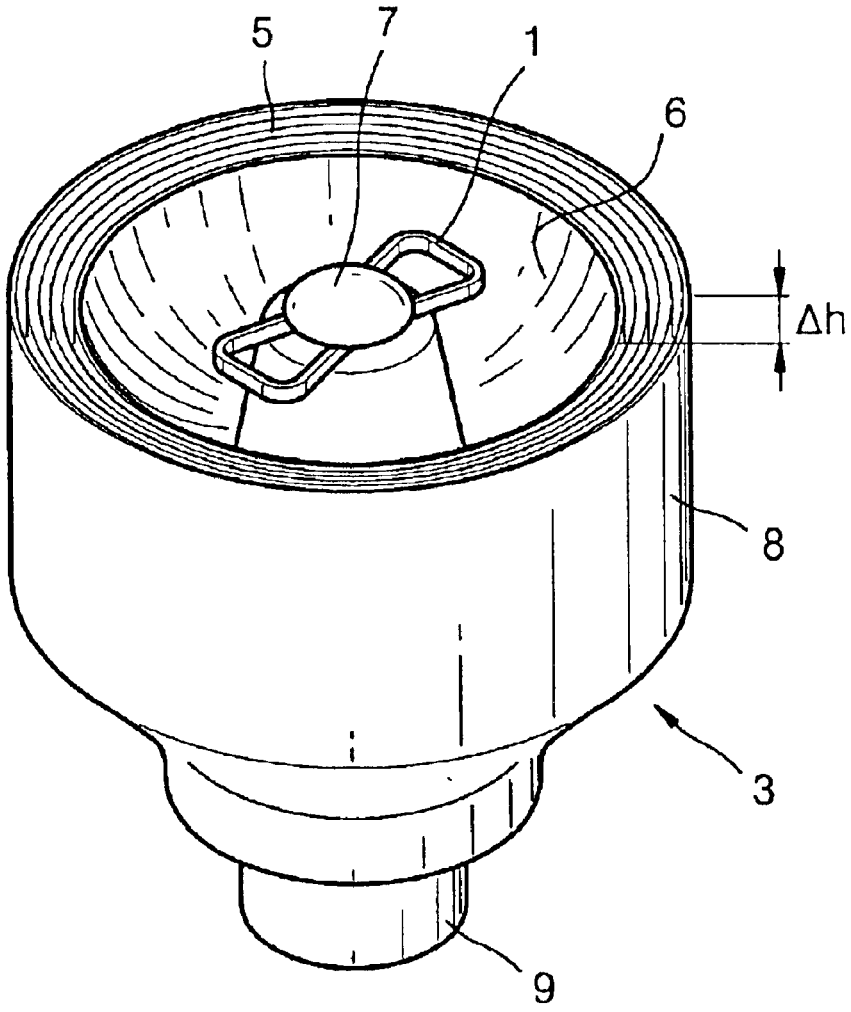
FIG. 1 illustrates a perspective view of an antenna apparatus according to a first embodiment of the present invention.

Korean Patent Application No. 2001-67828, filed Nov. 1, 2001, and entitled: "Antenna Apparatus," is incorporated by reference herein in its entirety.

Preferred embodiments of an antenna apparatus according to the present invention will be described in detail with reference to the accompanying drawings. In the drawings, like reference numerals refer to like elements throughout.

Figure 2:
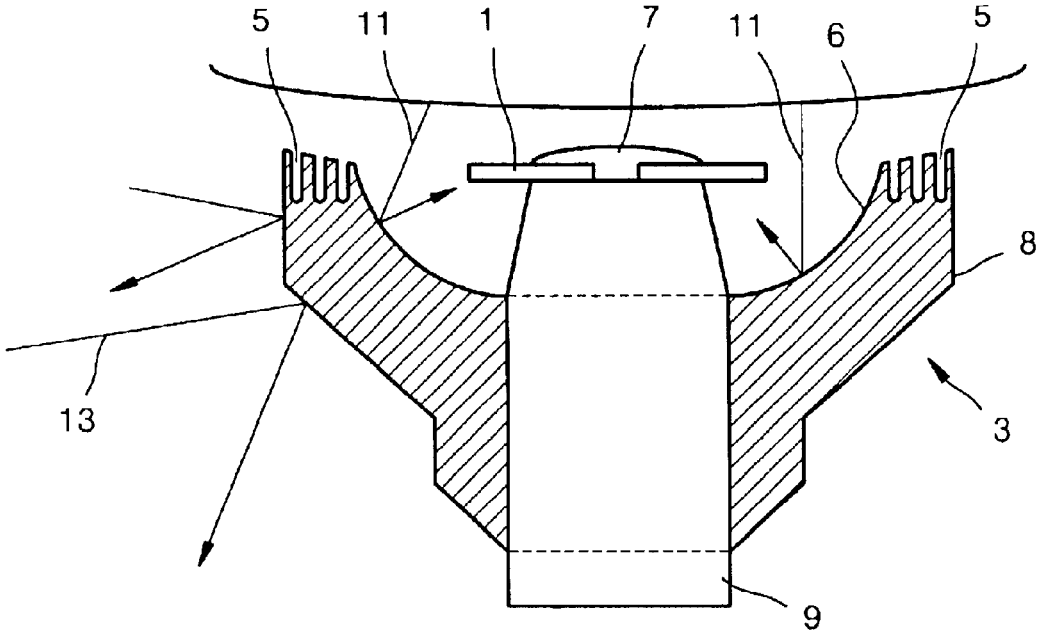
FIG. 2 illustrates a sectional view of the antenna apparatus of FIG. 1.

FIGS. 1 and 2 illustrate an antenna apparatus according to a first embodiment of the present invention. Referring to FIGS. 1 and 2, the antenna apparatus includes a ribbon-shaped antenna 1, which is a folded dipole antenna, a condensing element 3 surrounding the antenna 1, and grooves 5 formed along a periphery portion of the condensing element 3. The antenna 1 is a contact type antenna that directly contacts a target object (not shown) to be measured to receive electromagnetic radiation from the target object.

An object whose temperature is greater than or equal to absolute zero emits electromagnetic radiation of a predetermined frequency band. Electromagnetic radiation of an infrared region from an object is detectable by an infrared (IR) camera. Electromagnetic radiation of an RF frequency band from an object is detectable by a radiometer with an RF-oriented antenna and a high-sensitivity receiver.

A radiometer for the human body is used for estimating a temperature distribution inside tissue by receiving RF radiation from the body tissue. In consideration of the characteristic of the body medium, an antenna for a frequency band of 1–6 GHz is used in the radiometer.

When the target object is a human body, the antenna 1 contacts the skin to receive electromagnetic radiation from the body. When the antenna 1, which directly contacts the body, is tilted, a main lobe direction of the antenna is also tilted. As a result, the electromagnetic radiation from the body is not able to be received accurately.

The condensing element 3 includes an interior wall 6 coated with an electromagnetic reflecting material, or to which an electromagnetic reflecting material is attached, to reflect and condense electromagnetic radiation 11 from the body; an exterior wall 8 coated with an electromagnetic reflecting material, or to which an electromagnetic reflecting material is attached, to block external electromagnetic radiation 13; and grooves 5 formed to a predetermined depth in a direction in which electromagnetic waves are radiated from the target object. The grooves 5 are formed in an intermediate wall between the interior wall 6 and the exterior wall 8.

The condensing element 3 supports the antenna 1, prevents the antenna 1 from moving, and condenses the electromagnetic radiation 11 toward the antenna 1.

The condensing element 3 supports the antenna 1 so that it contacts the target object while being maintained at an initial position and angle thereof to make a correspondence the main lobe direction to an electromagnetic radiation pattern from the target object. As a result, the electromagnetic reception reliability of the antenna 1 is improved.

The condensing element 3 may be made of a conductive metal to reflect electromagnetic waves incident on the interior wall 6 to converge toward the antenna 1. Alternatively, the interior wall 6 of the condensing element 3 may be coated with an electromagnetic reflecting material, or an electromagnetic reflecting material may be attached to the interior wall 6 to improve electromagnetic reception efficiency.

When the condensing element 3 is formed of a conductive metal, as described above, external noise, i.e., an unnecessary, unwanted external signal, can be blocked. Alternatively, the exterior wall 8 of the condensing element 3 may be coated with an electromagnetic reflecting material, or an electromagnetic reflecting material may be attached to the exterior wall 8 to shield external electromagnetic radiation not originating from the target object.

The condensing element 3 may be formed in any shape that is capable of efficiently blocking and reflecting electromagnetic radiation, for example, a semi-spherical shape. The interior wall 6 of the condensing element 3 may be formed to be semi-spherical, spherical or cylindrical.

In the intermediate wall between the interior wall 6 and the exterior wall 8 of the condensing beam 3, at least one groove 5 is formed to a predetermined depth in a direction in which the target object radiates electromagnetic waves to block the unnecessary, i.e., unwanted, signal 13. A curvature and structure of the interior wall 6 of the condensing element 3 and a structure of the grooves 5 are determined so as to block as much electromagnetic radiation as possible.

In the antenna apparatus according to the first embodiment of the present invention, three grooves 5 are formed. In addition, the height of the exterior wall 8 is greater than the height of the interior wall 6 by $\Delta h$. The number of grooves 5 may be varied according to the electromagnetic radiation to be blocked and the electromagnetic radiation to be received.

An inner surface of the grooves 5 may be coated with an electromagnetic absorbing material, or an electromagnetic absorbing material may be attached to the inner surface of the grooves 5 to absorb the unwanted signal 13. Alternatively, the inner surface of the grooves 5 may be coated with an electromagnetic reflecting layer, or an electromagnetic reflecting material may be attached to the inner surface of the grooves 5 to reflect the unwanted signal 13. Preferably, a top surface of the condensing element 3 is inclined toward the antenna 1 to provide more secure contact between the target object, such as a human body, and the condensing element 3 and the antenna 1.

A cable 9 transmits an intended signal 11 received via the antenna 1 after having been reflected from the interior wall 6 of the condensing element 3 to, for example, a radiometer (not shown). The antenna 1 is fixed to the top of the cable 9 by an adhesive 7.

Figure 3:
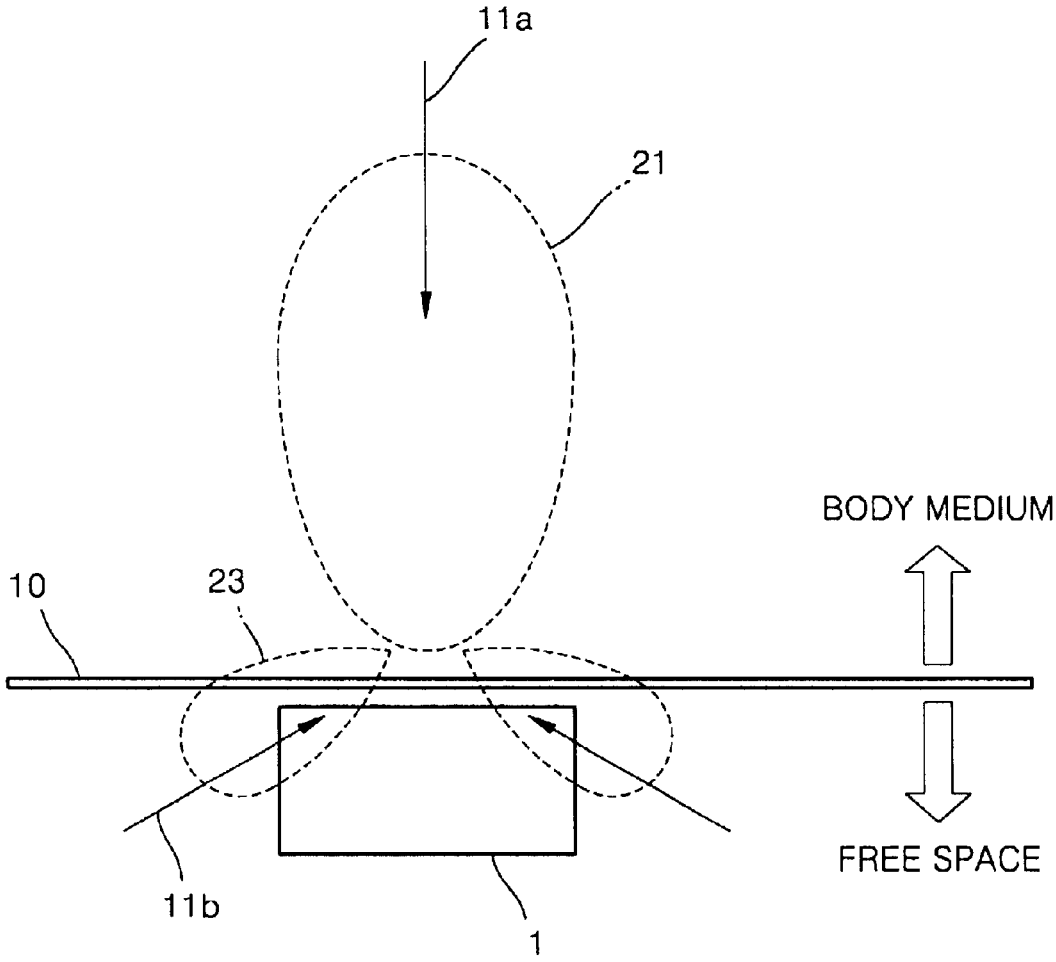
FIG. 3 shows an electromagnetic radiation pattern when an antenna apparatus according to the present invention is applied to a body medium, for illustrating the operational principles of the antenna apparatus.

FIGS. 2 and 3 illustrate the operational principles of an antenna apparatus according to the present invention. Referring to FIG. 3, the condensing element 3 directly contacts a surface of the target object 10 such that the necessary, i.e., intended, signal 11 is emitted toward the interior wall 6 of the condensing element 3, and the external unwanted signal 13 is blocked by the exterior wall of the condensing element 3.

In FIG. 3, the electromagnetic radiation from the target object, e.g., a body, 10 propagates a main lobe 21 and a minor lobe 23. An electromagnetic wave 11*a* propagated to the main lobe 21 is directly received by the antenna 1, whereas an electromagnetic wave 11*b* propagated to the minor lobe 23 is received by the antenna 1 after being reflected by a certain medium in the free space.

According to the present invention, the condensing element 3, which may be formed by coating an electromagnetic reflecting material on or by attaching an electromagnetic reflecting material to the interior wall 6, is used to reflect the electromagnetic wave in the minor lobe 23 to converge the electromagnetic wave in the minor lobe 23 on the antenna 1, thereby improving the electromagnetic reception efficiency of the antenna 1.

The unwanted signal 13 is blocked by the condensing element 3 by being reflected from the exterior wall 8 of the condensing element 3 or by being reflected from or absorbed by the grooves 5, so that the unwanted signal 13 does not reach the antenna 1.

Figure 4:
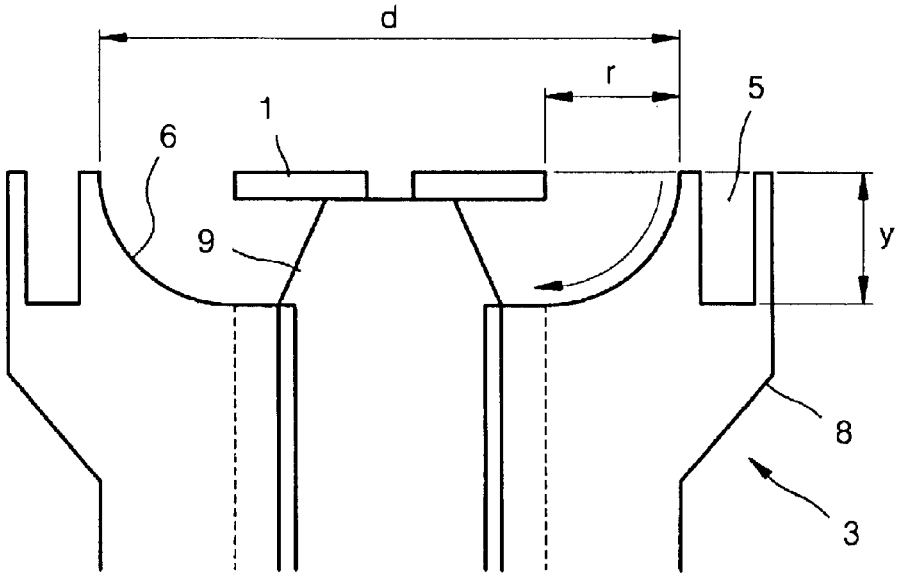
FIG. 4 illustrates a sectional view of an antenna apparatus according to a second embodiment of the present invention.

FIG. 4 illustrates a sectional view of an antenna apparatus according to a second embodiment of the present invention. Referring to FIG. 4, the antenna apparatus includes a single groove 5 between the interior wall 6 and the exterior wall 8 of the condensing element 3. In the FIG. 4, unlike the antenna apparatus according to the first embodiment of the present invention as shown in FIG. 3, the interior wall 6 and the exterior wall 8 have an equal height, i.e., $\Delta h=0$. Alternatively, however, the antenna apparatus according to the second embodiment of the present invention may be designed having a single groove and an interior wall 6 and an exterior wall 8 having different heights.

The antenna 1, the condensing element 3, the groove 5, and the cable 9 are sufficiently similar to those of the antenna apparatus according to the first embodiment of the present invention, and thus descriptions thereof will be omitted here.

In the antenna apparatus according to the second embodiment of the present invention, as shown in FIG. 4, an opening diameter d is adjusted depending on the intensity of electromagnetic radiation. The opening diameter d is directly proportional to the intensity of electromagnetic radiation (I). Accordingly, the opening diameter d of the antenna apparatus is increased with increasing intensity of the electromagnetic radiation to be received. However, since the intensity of the electromagnetic radiation to be received is largely dependent on the frequency band of an antenna or a radiometer that is applied to the target object, increasing the opening diameter d beyond a predetermined limit is not effective to increase the intensity of the electromagnetic radiation received by the antenna or radiometer.

The electromagnetic radiation received by the antenna is also dependent on the radius of curvature r of the interior wall 6 of the condensing element 3. The radius of curvature r is determined in order to provide the condensing element 3 with sufficient inner volume for the intended signal from the target object.

As well as the radius of curvature r, the opening diameter d affects resolution (R), as governed by equation (1) below:

$$R = \frac{I}{V} \tag{1}$$

where I denotes the intensity of electromagnetic radiation, and V denotes a volume of the target object.

The rate at which the intensity of the electromagnetic radiation I increases with the increasing opening diameter d is lower than the rate at which the volume V of the target object contacting the condensing element 3 increases with increasing the opening diameter d. Accordingly, as the opening diameter d increases, the resolution R is lowered. The resolution R is largely dependent on the frequency band of the radiometer used. This dependence is because the intensity of the electromagnetic radiation I is more dependent on the measuring frequency band than on the opening diameter d of the condensing element 3.

To improve the electromagnetic reception efficiency of the antenna 1, the opening diameter d, the radius of curvature r, and a depth y of the groove 5 are optimally determined.

Figure 5:
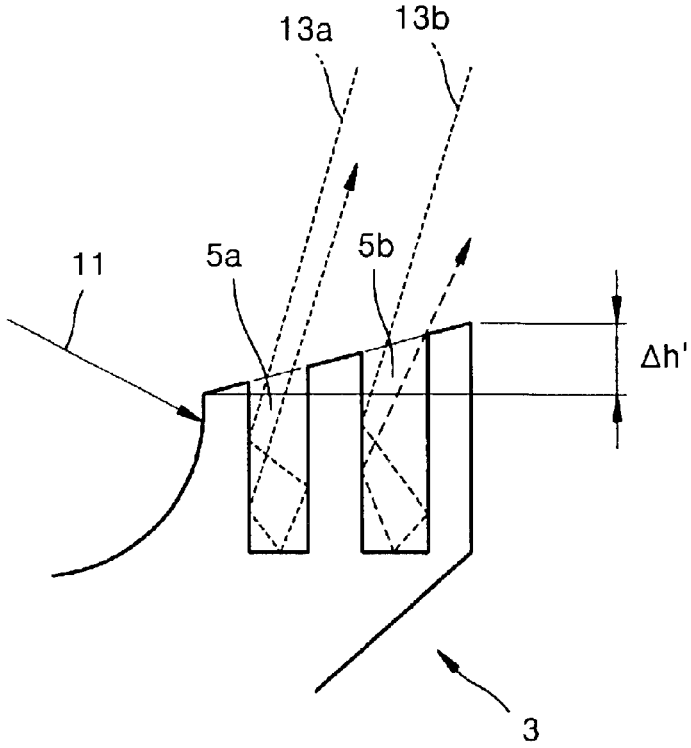
FIG. 5 illustrates a sectional view of an antenna apparatus according to a third embodiment of the present invention.

FIG. 5 illustrates an antenna apparatus according to a third embodiment of the present invention. Referring to FIG. 5, the antenna apparatus includes two grooves 5*a* and 5*b* between the interior wall 6 and the exterior wall 8 of the condensing element 3. As in the antenna apparatus according to the first embodiment of the present invention described above, the interior wall 6 and the exterior wall 8 have different heights in FIG. 5. The height difference between the interior wall 6 and the exterior wall 8 in the third embodiment of the present invention, as shown in FIG. 5, is denoted $\Delta h'$.

The antenna (not shown), the condensing element 3, the grooves 5*a* and 5*b*, and the cable (not shown) are sufficiently similar to those in the antenna apparatus according to the first embodiment of the present invention, and thus descriptions thereof will be omitted here.

In FIG. 5, the principles of blocking unnecessary, unwanted signals 13*a* and 13*b* by the grooves 5*a* and 5*b* are illustrated. The unwanted signal 13*a* is reflected toward the free space from the inner surface of a first groove 5*a*, which may be coated with an electromagnetic reflecting material or to which an electromagnetic reflecting material may be attached. The unwanted signal 13*b* is gradually absorbed up to a considerably low intensity by the inner surface of a second groove 5*b*, which may be coated with an electromagnetic absorbing material or to which an electromagnetic absorbing material may be attached, and proceeds toward the free space having the reduced intensity of the electromagnetic radiation. Reception of the intended signal 11 is also illustrated.

In an antenna apparatus according to the present invention, the number of grooves 5, the depth of the grooves in the condensing element 3, and the heights of the interior wall 6 and the exterior wall 8 of the condensing element 3 may be experimentally determined to optimal levels, as described above.

Figure 6:
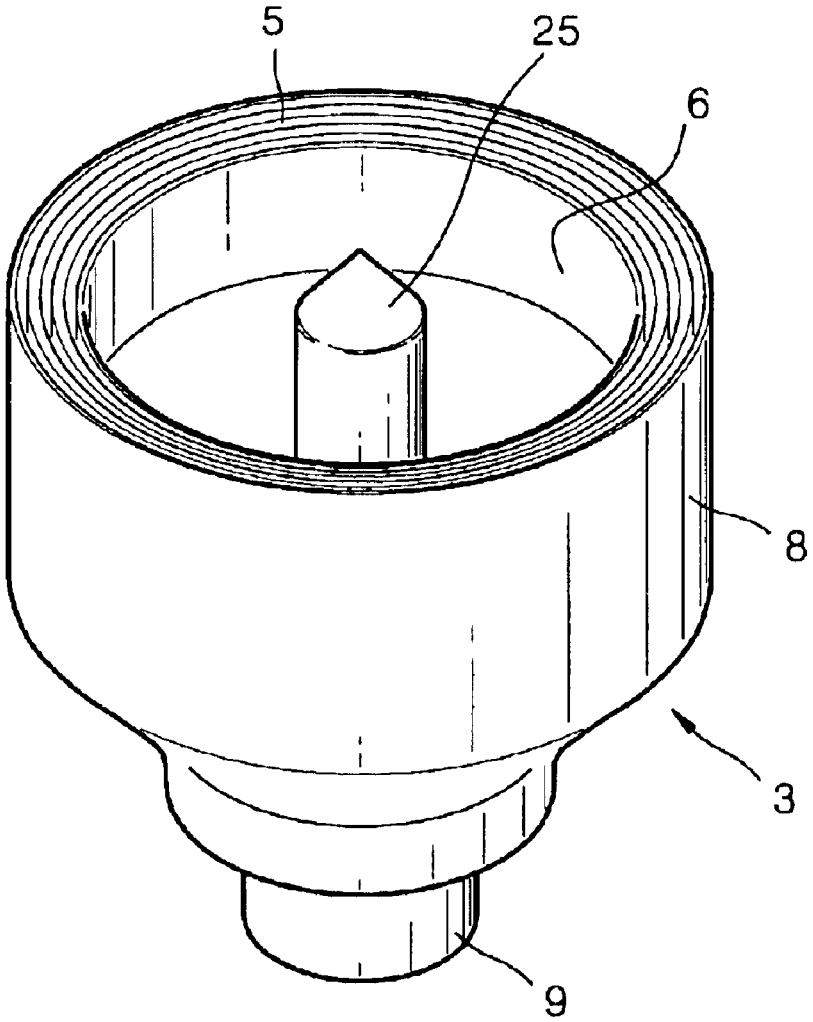
FIG. 6 illustrates a perspective view of an antenna apparatus according to a modification of the first embodiment of the present invention.

FIG. 6 illustrates a modification of the antenna apparatus according to the first embodiment of the present invention. In the modified example of FIG. 6, instead of the antenna 1 being configured as shown in FIG. 1, a probe-type antenna 25 is used, and the interior wall 6 of the condensing element 3 is formed in cylindrical form. The probe-type antenna 25 is largely used for geological survey purposes. Since the structure and function of the condensing element 3 have been described in the first embodiment according to the present invention, descriptions thereof will be omitted here.

To verify the effect of the antenna apparatus according to the present invention, the antenna apparatus according to the second embodiment of the present invention described above was practically manufactured and connected to a radiometer for a human body. The results are set forth below.

Experiments were conducted in an electromagnetic wave shielded room and a non-electromagnetic wave shielded room using and without using the antenna apparatus according to the present invention, 25 times for each case. The radiometer used had a frequency band of 1.75 GHz, and the values in the following table are values measured by the radiometer. A greater value indicates that more noise is received. The radiometer used in the experiment was designed to measure a value in the range of 30–40°.

Accordingly, the values greater than 40° in the following table have no meaning as being experimental error.

| Experiment No. | The case of using the antenna apparatus according to the present invention | | The case of using no antenna apparatus according to the present invention | |
|---|---|---|---|---|
| | Shielded Room | Non-shielded Room | Shielded Room | Non-shielded Room |
| 1 | 34.7 | 34.6 | 44.2 | 35.1 |
| 2 | 34.9 | 34.4 | 48.1 | 35.1 |
| 3 | 34.8 | 34.6 | 48.5 | 35 |
| 4 | 34.8 | 34.6 | 43.7 | 35.1 |
| 5 | 34.7 | 34.5 | 41.7 | 35.1 |
| 6 | 35 | 34.5 | 40.9 | 35 |
| 7 | 35.2 | 34.4 | 39.3 | 35 |
| 8 | 34.9 | 34.5 | 40.4 | 35 |
| 9 | 34.8 | 34.6 | 40.9 | 35.2 |
| 10 | 34.7 | 34.5 | 39.5 | 34.9 |
| 11 | 34.6 | 34.5 | 39.8 | 35.1 |
| 12 | 34.7 | 34.6 | 42.5 | 35.1 |
| 13 | 34.7 | 34.5 | 41 | 35 |
| 14 | 34.7 | 34.5 | 42.1 | 34.9 |
| 15 | 34.9 | 34.5 | 41.6 | 34.9 |
| 16 | 34.9 | 34.6 | 42.4 | 35.1 |
| 17 | 35 | 34.5 | 40.5 | 35.1 |
| 18 | 35 | 34.5 | 39.1 | 35.1 |
| 19 | 35 | 34.6 | 41 | 35.1 |
| 20 | 35 | 34.6 | 40.6 | 35 |
| 21 | 34.9 | 34.4 | 41.4 | 35.2 |
| 22 | 34.8 | 34.5 | 42.3 | 35.2 |
| 23 | 34.9 | 34.6 | 44.8 | 35.1 |
| 24 | 35.1 | 34.5 | 44.6 | 35.1 |
| 25 | 34.9 | 34.6 | 41 | 35.1 |
| Mean | 34.864 | 34.528 | 41.89 | 35.045 |
| Standard Deviation | 0.1440 | 0.0665 | 2.3814 | 0.0826 |

In the case using the antenna apparatus according to the present invention, the mean value was 34.864° in the non-shielded room and 34.528° in the shielded room. In the case using no antenna apparatus to the present invention, the mean value was 41.89° in the non-shielded room and 35.045° in the shielded room. Accordingly, it may be seen that the antenna apparatus according to the present invention has a significant effect on blocking unwanted electromagnetic radiation.

In addition, when the antenna apparatus according to the present invention is used, similar results were obtained in the shielded room and non-shielded room, which supports improved performance reliability of the antenna apparatus according to the present invention.

In an antenna apparatus according to the present invention, a condensing element, which supports an antenna, prevents the antenna from moving and converges electromagnetic radiation toward the antenna, is used. In addition, the condensing element may be preferably formed of a metal member or may include a groove, so that the gain and reception efficiency of the antenna are improved. Therefore, when the antenna apparatus according to the present invention is applied to a measuring device, measurement accuracy, reliability, and resolution of the device are improved.

As described above, an advantage of the present invention is that the antenna is tightly supported to prevent movement and to converge electromagnetic radiation from a target object to be measured by the antenna. Additionally, unwanted noise is blocked, thereby improving the electromagnetic reception efficiency of the antenna.

Preferred embodiments of the present invention have been disclosed herein and, although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An antenna apparatus comprising:

a contact type antenna for receiving electromagnetic radiation from an object to be measured through direct contact with the object; and a condensing element, which surrounds the antenna, the antenna being centered in the condensing element, wherein the condensing element reflects and condenses the electromagnetic radiation toward the antenna.

2. The antenna apparatus as claimed in claim 1, wherein the condensing element is formed of a conductive metal.

3. The antenna apparatus as claimed in claim 1, wherein the condensing element comprises:

an interior wall including an electromagnetic reflecting material to reflect and converge the electromagnetic radiation toward the antenna;

an exterior wall including an electromagnetic reflecting material to shield external electromagnetic radiation not originating from the object to be measured; and an intermediate wall between the interior wall and the exterior wall, which includes at least one groove formed to a predetermined depth in a direction of wave propagation.

4. The antenna apparatus as claimed in claim 3, wherein the interior wall is semi-spherical.

5. The antenna apparatus as claimed in claim 3, wherein the interior wall is cylindrical.

6. The antenna apparatus as claimed in claim 3, wherein the interior wall and the exterior wall have different heights.

7. The antenna apparatus as claimed in claim 3, wherein the interior wall and the exterior wall have an equal height.

8. The antenna apparatus as claimed in claim 3, wherein the at least one groove contains an electromagnetic reflecting material on an inner surface thereof.

9. The antenna apparatus as claimed in claim 3, wherein the at least one groove contains an electromagnetic absorbing material on an inner surface thereof.

10. An antenna apparatus comprising:

an antenna for receiving electromagnetic radiation from an object to be measured; and a condensing element, which surrounds the antenna, the antenna being centered in the condensing element, wherein the condensing element reflects and condenses the electromagnetic radiation toward the antenna and includes:

an interior wall including an electromagnetic reflecting material to reflect and converge the electromagnetic radiation toward the antenna, wherein a top surface of the intermediate wall is inclined toward the antenna;

an exterior wall including an electromagnetic reflecting material to shield external electromagnetic radiation not originating from the object to be measured; and an intermediate wall between the interior wall and the exterior wall, which includes at least one groove formed to a predetermined depth in a direction of wave propagation.

* * * * *